US007040233B2

(12) United States Patent
Seyfried

(10) Patent No.: US 7,040,233 B2
(45) Date of Patent: May 9, 2006

(54) METHOD AND DEVICE FOR CONTROLLING THE DRIVE UNITS IN A PRINTING MACHINE

(75) Inventor: Rüdiger Karl Seyfried, Hettstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 57 days.

(21) Appl. No.: 10/483,425

(22) PCT Filed: Jul. 11, 2002

(86) PCT No.: PCT/DE02/02530

§ 371 (c)(1),
(2), (4) Date: May 12, 2004

(87) PCT Pub. No.: WO03/016059

PCT Pub. Date: Feb. 27, 2003

(65) Prior Publication Data

US 2004/0231542 A1 Nov. 25, 2004

(30) Foreign Application Priority Data

Jul. 23, 2001 (DE) ..... 101 35 773

(51) Int. Cl.
*B41F 1/34* (2006.01)

(52) U.S. Cl. ..... 101/485; 101/484; 101/483; 101/211

(58) Field of Classification Search ..... 101/483–486, 101/211, 219
See application file for complete search history.

(56) References Cited

U.S. PATENT DOCUMENTS 4,565,444 A 1/1986 Mactaggart
6,211,968 B1 4/2001 Glockner et al.
6,532,872 B1 3/2003 Siegl et al.
6,647,874 B1 11/2003 Siegl et al.
6,810,812 B1 * 11/2004 Fischer ..... 101/485
2002/0023560 A1 2/2002 Siegl et al.

FOREIGN PATENT DOCUMENTS

| | | |
|---|---|---|
| DE | 1966 795 | 8/1974 |
| DE | 29 14 730 | 10/1980 |
| DE | 26 46 341 C2 | 11/1982 |
| DE | 33 39 435 A1 | 5/1984 |
| DE | 36 05 168 C2 | 6/1989 |
| DE | 41 28 860 A1 | 3/1993 |
| DE | 197 23 043 A1 | 12/1998 |
| EP | 0 882 588 A1 | 12/1998 |
| EP | 0 951 993 A1 | 10/1999 |
| EP | 0 837 825 B1 | 1/2001 |
| EP | 0 882 588 B1 | 11/2001 |
| GB | 1 547 061 | 6/1977 |
| JP | 09-277494 | 10/1997 |

OTHER PUBLICATIONS

Harold Meis—Ethernet und SERBAS fur synchronisierte Antriebe in Vielachsanwendungen am Beispiel einer Zeitungsdruckmaschine.
Tagungsband_Nov. 28-30, 2000.

* cited by examiner

*Primary Examiner*—Minh Chau
(74) *Attorney, Agent, or Firm*—Jones Tullar & Cooper PC

(57) ABSTRACT

A method and a device for controlling drive units in a printing machine are disclosed. During continuous production, and in anticipation of a foreseeable disruption, one or more measuring values that are suitable for characterizing the disruption, are determined. The measuring values are used to estimate the expected variations caused by the disruptions in the variables affecting the printing process. The variables are preregulated or precontrolled directly before the start of the disruption or during the disruption.

15 Claims, 3 Drawing Sheets

METHOD AND DEVICE FOR CONTROLLING THE DRIVE UNITS IN A PRINTING MACHINE

FIELD OF THE INVENTION

The present invention is directed to methods and a device for controlling the drive units of a printing press. The printing press typically has several printing groups through which a web passes.

BACKGROUND OF THE INVENTION

A registration regulation procedure is known from EP 0 951 993 A1. An actual change of a longitudinal extension of a web is detected by measured values during printing, for example web speeds. The registration is reset by an appropriate register adjustment of the cylinder and registration rollers.

EP 0 837 825 B1 discloses a method for regulating web tension, wherein values which characterize the press state and method-related properties, are used for regulation of the web tension, in addition to the measured actual values of the web tension. Predeterminable web-specific parameters are also introduced into the regulating algorithm, besides the actually measured tension values.

In accordance with DE 36 05 168 C2, the modulus of elasticity of a web of material, and its cross section are entered into a control or regulating device. A matching of the regulating parameters affecting the chronological behavior and the amplification of the regulating device is performed by use of the modulus of elasticity.

EP 0 882 588 B1 discloses a web registration regulation on the basis of an indexing mark measured by a sensor whose regulating dynamics can be changed in view of predictable changes. A control is moreover disclosed, wherein predetermined register corrections are selected as a function of a speed measured at a cylinder and are communicated to a the drive regulation device. A predetermined system of curves can include characteristic curves for various types of presses, paper qualities and configurations, which curves are then selected in accordance with the existing conditions.

SUMMARY OF THE INVENTION

The object of the present invention is directed to providing methods and a device for controlling the drive units of a printing press.

In accordance with the present invention, this object is attained by controlling drive units of a printing press. Corrective values are supplied to the drive units in anticipation of web changes in tension or the like, which changes could affect registration or indexing. In web roll changes, at least one value, which may cause a deviation of a value affecting the printing process, is determined and is used to control the drive units. A time between the introduction of a new web, and its arrival at the printing unit can be determined and used to introduce the correction at the proper time. The corrective value which will compensate for the anticipated trouble can be introduced to the control units prior to the occurrence of the trouble.

The advantages to be gained by the present invention lie, in particular, in that by use of a pre-regulation, or a pre-control, it is possible to reduce the effect on the printing process to be expected in case of predictable trouble, and that the amount of waste being created can thereby be minimized. The measurement of characteristic values, and the detection of correction values, takes place chronologically before the trouble causing event, and the regulation occurs before, or at the same time as the appearance of the negative effects on an affected unit, not afterwards. The measurement, evaluation and reduction, or removal, of an effect of trouble to be expected therefore occurs prior to the trouble.

By the use of the regulation of the printing machine, in accordance with the present invention, it is possible to counteract, in particular, trouble during the change of the materials to be imprinted, particularly if the properties of, or the differences between the actual and the new webs are known. The amount of waste being created can thus be reduced.

This waste reduction is achieved, in an advantageous embodiment, in that prior to gluing the start of a fresh web of material to be imprinted, or prior to its entry into the printing press, its quality is determined. On the basis of this determination, the pre-regulation, or the pre-control of drive units or of displacement elements takes place also prior to the new web being glued on to the old web, or during the new web's entry, in view of the changes in the register and/or web the tension to be expected.

Because of the pre-control or pre-regulation in accordance with the present invention, the response times of the regulation device, which typically operates in a reviewing manner; cause, effect, countermeasures during production and/or at the time of the response, or of the asymptotic approach to the nominal value, are clearly reduced.

The employment of such a measuring and regulating principle by pre-control or pre-regulation is of particular advantage for the regulation of the registration and/or the indexing device of the printing press.

In case of a driven connection of several units, actuating devices are charged with previously determined correction values for the purpose of pre-regulating the registers or indexing devices. In case of the individual driving of independently driven rotatory units, such as, for example, printing groups or individual printing cylinders, corrections in the linear direction of the web are made, in an advantageous manner, by an appropriate change of the angular position of the individual drive unit, and therefore of the printing group cylinder, or the printing group.

If a regulation, which automatically operates during production, is lacking, the actuating drive units, or the individual drive units, can still be provided with a correction, for example by the use of an appropriate actuating command, at the appearance of trouble, or prior to the appearance of trouble, for example, at the time of the start of a new web, into the printing press. Theerror to be expected can be minimized or can be compensated for in this way.

The measuring and regulating principle in accordance with the present invention can also be applied, in an advantageous further embodiment, to a regulation of a web tension. Prior to the appearance of trouble, resulting from different web properties, the trouble's effects to be expected are determined and the affected drive unit or actuating device, for example tension regulators, torque regulators, etc., are supplied with an appropriate correction value either directly prior to the time of the appearance of the trouble, or at the time of the appearance of trouble.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

A rotary printing press, such as, for example, a web-fed rotary printing press, has a number of processing stages, or units, spaced in a web conveying direction T along a production direction, i.e. along the path of a web 01, for example a web 01 of material to be imprinted, and in particular along a path of a paper web 01.

Figure 1:
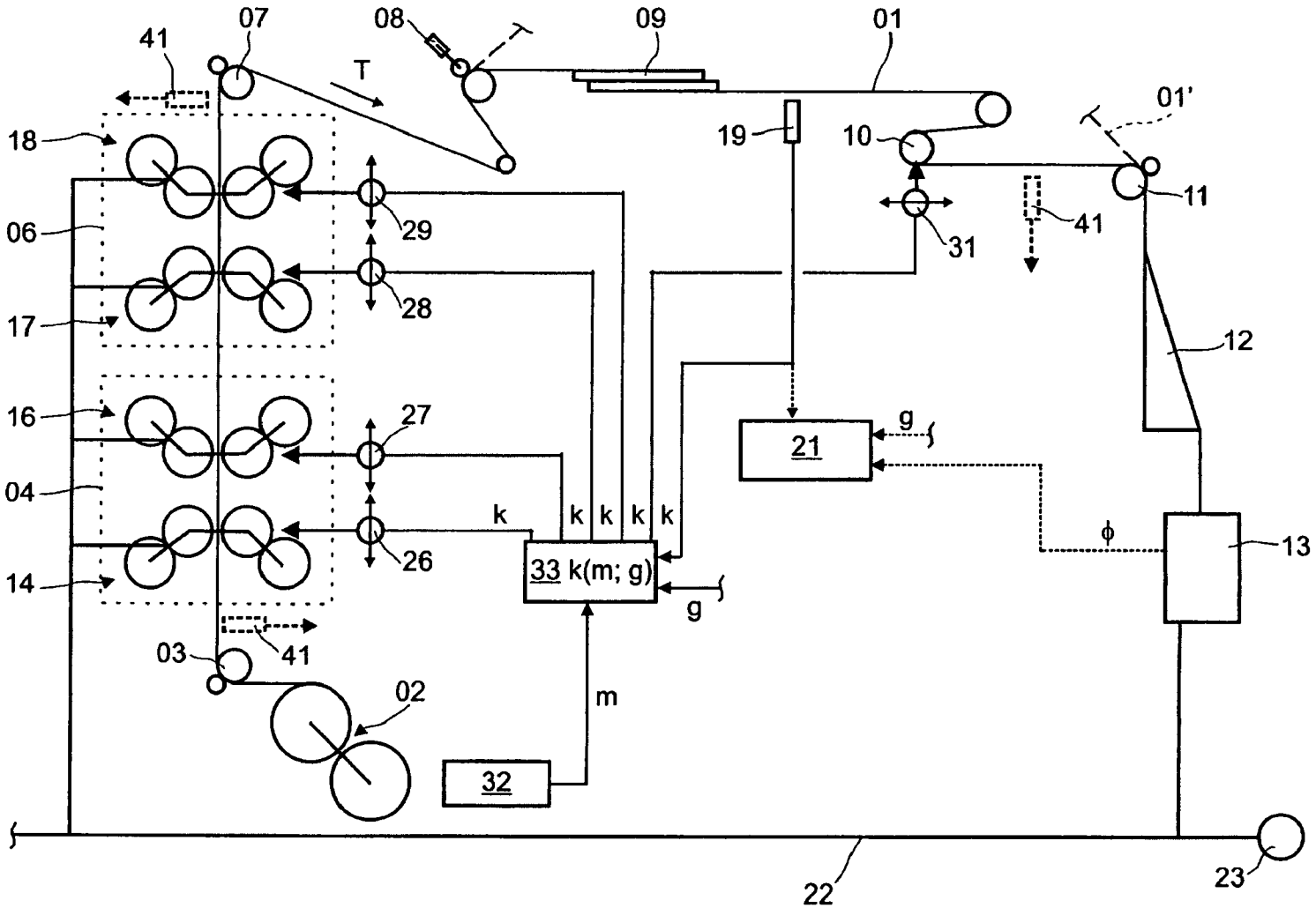
FIG. 1, a schematic representation of a rotary printing press with a main drive unit and register regulation in accordance with the present invention, in FIG. 2, a schematic representation of a rotary printing press with individual drive units and register regulation, and in FIG. 3, a qualitative representation of a chronological axis for the roll change and subsequent corrections.
Figure 2:
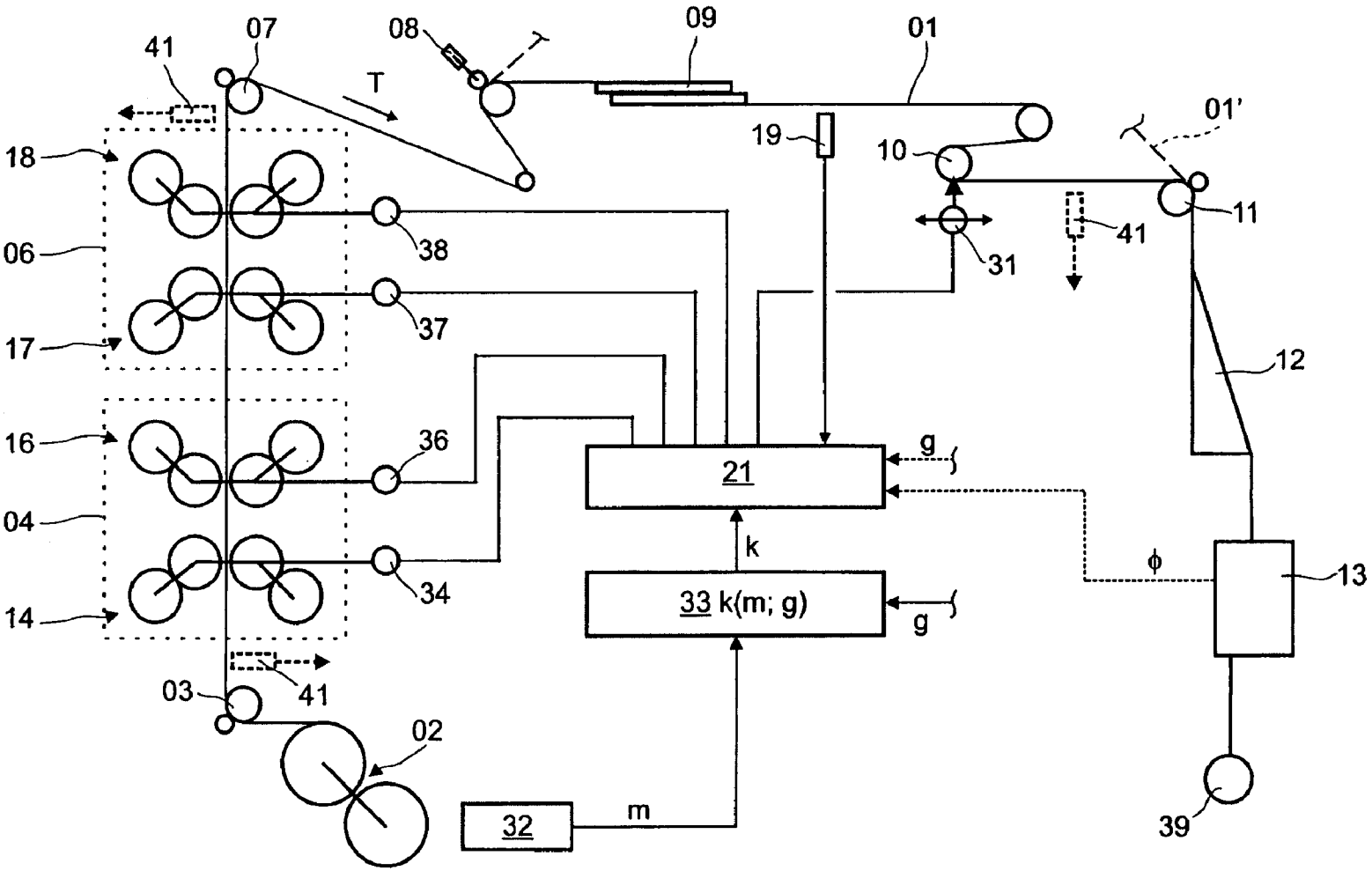

For a web-fed rotary printing press, such as is schematically represented in FIGS. 1 and 2, these processing stages or units can be, for example, units for providing a paper supply, such as a roll changer 02 with a draw-in unit or device 03; one, or a plurality of printing units 04, 06, a traction roller 07, possibly a linear cutting device 08, a turning device 09 or register devices 10, such as a linear register roller 10, for example, a further traction roller 11, as well as formers 12 and a folding apparatus 13 with transverse cutting devices, which are not specifically represented in FIGS. 1 and 2. In addition, further processing stages, which are not specifically represented, such as a coating unit, a dryer, and the like can be arranged in a web-fed rotary printing press in the web path.

Each printing unit 04, 06 has either one, or a plurality of printing groups 14, 16, 17, 18, which printing groups may be, for example, double groups 14, 16, 17, 18, for use in imprinting on both sides of the web 01. The printing groups 14, 16, 17, 18 can be arranged side-by-side or can also be arranged on top of each other. If several printing units 04, 06 exist, these several units 04, 06 can also be side-by-side or on top of each other, with a horizontal or vertical course of the web 01.

The web 01 is initially rolled off a roll changer 02 and passes through the printing groups 14, 16, 17, 18, which groups imprint the web sequentially, for example four times on the same side. The web 01 is possibly united, upstream of the former 12, with a second web 01' or with a partial web 01' from a second printing unit, which is not specifically represented, before web 01 is folded in the folding apparatus 13 and is transversely cut. If the web 01 is to be longitudinally cut in the folding superstructure, the second web 01' can, in particular, also be a turned partial web 01' of the longitudinally cut web 01.

In order to maintain the indexing devices on the web in place, in the course of multiple printing or, with two-sided imprinting, maintaining the registry, and, when combining several webs 01, 01', or partial webs 01, 01', and with transverse cutting, to maintain the cutting register, the keeping of the indexing devices in place, or the registry, are customarily checked at one or at several locations along the path of travel of the web 01. In connection with fully automatic printing presses, this checking is accomplished, for example, by measuring the position of marks or printed images applied by the printing groups 14, 16 by the use of a sensor represented, by way of example, at 19 in FIGS. 1 and 2.

In the case of an automatic register regulation, signals from the sensor 19 are supplied to a regulating device 21. This regulating device 21 is configured for use in correcting registered deviations in the indexing devices and the register, such deviations being ones occurring in the linear direction x of the web 01, as well as in its transverse direction y.

Several of the printing press units mentioned above, in this case the printing groups 14, 16, 17, 18 and the folding apparatus 13, are, in the first embodiment depicted in FIG. 1, mutually rotatorily driven via a mechanical driving connection 22 by a main drive unit 23. The mechanical driving connection 22 can have gears, which are not specifically represented, for example with changeable gearing.

The signals from the sensor 19 are supplied to the regulating device 21, which, in turn, acts on, or controls, actuating devices 26, 27, 28, 29, 31, or drive units 26, 27, 28, 29, 31. For example, regulating device 21 acts on, or controls, actuating drive units 26, 27, 28, 29, 31, such as linear register drive units 26, 27, 28, 29 of the printing groups 14, 16, 17, 18, or on drive units 31 of the linear register rollers 10. Further, drive units or actuating drive units, which are not specifically represented, for the lateral register, permit the correction of the web in a direction transversely, with respect to the web 01, or to the web conveying direction T. It is also possible to assign a linear register drive unit 26, 27, 28, 29 to each of the forme cylinders of the printing groups 14, 16, 17, 18, which here are embodied as double printing groups 14, 16, 17, 18.

The regulating device 21, which operates in a reviewing manner, assures the keeping of the indexing devices or the registry in place and, in case of a measured deviation $\Delta$ x, or $\Delta$ y from an actual value x-lst, y-lst, returns these to the desired nominal values x-soll, y-soll, or to the desired relative position of the printing groups 14, 16, 17, 18, with respect to each other, by actuating the actuating drive units 26, 27, 28, 29, 31, respectively. In this way, the regulating device 21 acts in response to already existing and registered troubles and to the changes resulting from them.

The causes of such troubles, and the changes resulting therefrom, are numerous. For example, changes in the state of the press, such as accelerations, changes of values with regard to the printing process, such as dampening fluid or ink supply, changes in the web tension, changes in contact pressures, and in particular also changes in the properties of the web 01, such as the tension-expansion behavior, the thickness, the moisture absorption, etc. of the web all give rise to troubles that cause changes in web registry and indexing.

If the changes in the properties of the web 01 are substantial, such as are possible, for example, during a change from one paper web 01 to another, because of the operation of the regulating device 21, a longer or extended time can be required for returning the actual values x-lst, y-lst to the nominal values x-soll, y-soll. Such an extended operation time or a longer response time of the regulating device 21, can therefore result in an increased amount of waste of the paper web 01.

To keep this response time, or the resultant amount of waste of paper web 01, as low as possible, at least one or possibly several characteristics of the properties of the fresh web are determined before the appearance of trouble, i.e. prior to the change or entry of the fresh web. These characteristics of the fresh web may be determined, for example, before a fresh web is glued to the old one during a flying change.

The determination of these characteristics of the web properties is performed by the use of a measuring system 32, which is arranged in close proximity to the roll changer 02, for example. The measuring system 32 contains optical, acoustic, electromagnetic, capacitive or radiological measuring instruments, for example, which, by determination of measured values "m", which are obtained on the surface of the fresh web, for example, permit the drawing of conclusions regarding properties or quality of the fresh web, such as, for example, its actual moisture, the thickness of the web, its tension- expansion characteristics, the absorption capacity for moisture, and the like.

From the measured values "m" of the fresh web obtained in this way, information-providing characteristics regarding the quality of the fresh web, for example, are formed in an evaluation unit 33 which, as depicted in FIG. 1, is embodied as a separate computer and memory unit 33.

The evaluation unit 33 is preferably additionally provided with the essential values "g" affecting the properties, or the behavior of the web 01, during the printing process as well. These values "g" are derived from the state of the press and the web guidance, for example, the dampening fluid or ink supply, the actual web tension, contact pressures, speeds, temperatures, accelerations, number of webs, path of the webs, and the like.

It is also advantageous if data regarding deviations $\Delta x$, $\Delta y$, or their characteristic numbers, and the corrections k0, the portion by use of the evaluation unit 33 prior to the change and including the portion of the later correction by use of the regulating device 21 detected in the past, are stored in the memory of the evaluation unit 33. In a further development, such an evaluation unit 33 can be embodied as a self-learning system, and in this way can optimize the regulating process taking place ahead of the roll change.

The evaluation unit 33 forms either one correction value "k" or several correction values "k" from the measured values "m", or from the characteristic numbers, together with the values "g" from the printing process and from the possibly previously stored corrections k0. For example, these correction values "k" are supplied, in the simplest case, as additive terms (offset) or as factors (spreading) to the actuating drive units 26, 27, 28, 29, 31 in the first preferred embodiment shown in FIG. 1 directly or, as represented in the second preferred embodiment of FIG. 2 via the regulating device 21, and cause a corresponding correction in the register devices or in the indexing devices. For the lateral register of the web, this correction can be, for example, a lateral movement of the affected unit, for the linear register of the web, a relative angular change $\Delta\phi$ for rotating units, a translatory movement in the linear direction x or a pivoting of a linear register roller 10, for example. The connection of the regulating device 21 with the actuating drive units 26, 27, 28, 29, 31 is not represented in FIG. 1 for reasons of clarity.

In the case of an automatic register control, in particular, it is possible to take the automatic register control temporarily out of action in order to bring the register or the indexing devices, in the meantime, into the desired position by use of the correction value "k". This can become necessary if, based on the signals from the sensor 19, the regulating device 21 would tend to reverse a change forced by the correction values "k". In that case, the correction values "k" can correspond to new nominal values before the regulation of the register or of the indexing devices is again left to the regulating device 21.

The same applies to charging the drive units affecting the web tension with a correction value "k" in case of an automatic web tension regulation.

The correction is preferably performed, at the latest, at a time which coincides with the appearance of trouble at a unit affected by trouble. For example, at the latest, this time can be the moment of the entry of the fresh web 01 into the second processing stage, for example into the second printing group 16. It is also possible to select the time to be the time of exit or the time of entry of the gluing point between the old web and the new web out of, or into the draw-in device 03 or, in the case of flying roll changers, during or immediately prior to gluing, for example. In the case of static roll changers, the regulation can take place with the leaving of the web from the storage device and/or the entry of the web into a draw-in device. If the path of the web 01 through the printing press is very long and if the path of the web 01 runs through many units, it can be of advantage to perform the corrections chronologically offset with respect to each other, i.e. timed with the progress of the gluing point respectively at the unit affected by trouble prior to the passage of the trouble spot.

In the second preferred embodiment, depicted in FIG. 2, the printing groups 14, 16, 17, 18 and the folding apparatus 13 are, for example, not mutually driven. Each one is driven individually by its own drive and without a positive driving connection. However, it is also possible to form larger, mutually driven sub-units. For example, a printing unit 04, 06, or also further reduced individually driven sub-units, for example each pair consisting of a forme and a transfer cylinder of each cylinder unit can be formed.

For regulating the indexing devices or the register in the linear direction x, the actuating drive units 26, 27, 28, 29 of the rotatorily correctable units, for example of the printing groups 14, 16, 17, 18, can be omitted. Here, a correction takes place by a change of the angular position $\Delta\phi$ of the respective drive units 34, 36, 37, 38, and possibly 39, and therefore by a change of the cylinders which are connected with the drive units 34, 36, 37, 38, and possibly 39. The drive units 34, 36, 37, 38, and possibly 39, to be regulated in this way, are preferably embodied as electric motors 34, 36, 37, 38, and possibly 39, whose angular positions can each be regulated. A change of the path length in the linear direction "x" to be corrected can take place, for example, as was the case in the first preferred embodiment of FIG. 1 by charging the actuating drive mechanism 31 of the linear register roller 10 with a correction value "k". The same applies to the correction of the lateral registers in the transverse direction "y" by operation of non- represented actuating drive units.

What was stated in connection with the first preferred embodiment of FIG. 1 should be applied accordingly in regard to the regulating principles, the determination of the correction values "k" and for supplying the correction values "k" to the drive units 34, 36, 37, 38, and possibly 39.

Figure 3:
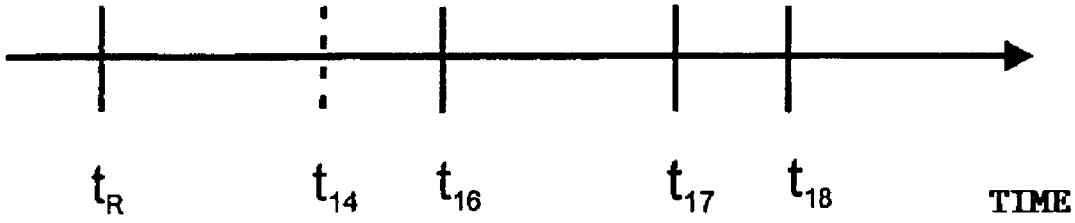

An embodiment of the present invention is advantageous wherein the correction is performed at each printing group, or double printing group 14, 16, 17, 18, as depicted in FIG. 3 at the respective optimized time $t_{14}$, $t_{16}$, $t_{17}$, $t_{18}$. Taking the web paths, the time $t_R$ of the roll change and the speed of the web into consideration, it is then possible to change the relative angle of rotation position of several printing groups 14, 16, 17, 18 successively each by an appropriate correction value "k". If the drive unit, or units 34 of the first printing group 14, for example, are used as a reference or sample, the angle of rotation position of each of the one or several successive printing groups 16, 17, 18 is then charged with an appropriate correction prior to the entry of the gluing point into that respective printing position. This time can be determined for each drive unit 34, 36, 37, 38, or for each printing group 14, 16, 17, 18 by using the web speeds, the web paths and the time $t_R$ of the roll change. The inertia of the system, and the finite length of the change of the relative angle of rotation position must additionally be taken into consideration in that, for example, the time $t_{14}$, $t_{16}$, $t_{17}$, $t_{18}$ of the charge of each unit 14, 16, 17, 18 respectively, with a correction value lies appropriately ahead of the actual entry of the gluing point into the respective printing group 14, 16, 17, 18. However, this can already be taken into consideration in the course of the determination, or fixing, of the time $t_{14}$, $t_{16}$, $t_{17}$, $t_{18}$, possibly as a function of values "g". The size of the deviation Δx, Δ y to be expected is determined, for example, by use of information regarding the quality of the fresh, and possible of the old web 01, for example by measured values "m", or by already existing information.

The above-described successive pre-control of each successive unit can be transferred, in the same way, from the example of the drive units 34, 36, 37, 38 of individually driven printing groups 14, 16, 17, 18 to the drive units 26, 27, 28, 29 in FIG. 1, and/or to drive units for controlling the lateral register.

In a third preferred embodiment of the present invention, which is not specifically represented in the drawings, the characteristic numbers relevant for the web tension of the web 01 are determined by use of measured values picked up with the aid of the measuring system 32. The tensions in the web 01 are here what the linear direction "x" and the transverse direction "y" as the values "x", "y" affecting the printing process had been in the previous examples. Correction values "k", which are applied as an offset, for example prior to, or at the appearance of the trouble, to the units affecting the web tension, such as the drive unit or the regulating device of the draw-in device 03, a traction roller 07, 11, and/or to the drive unit or to the regulating device of a compensating roller, which is not specifically represented, are determined from these characterizing numbers, together with the values "g" for the press status and the printing process, and possibly with past data stored in the evaluation unit 33. The values "g" characterizing the actual press status can contain, for example, measured values "m" regarding the actual web tension, represented by way of example by dashed lines in FIGS. 1 and 2 as sensors 41, such as compensating rollers, measuring rollers, etc., for example. If this takes place successively with the progression of the gluing point through the printing press, tension peaks, or tension drops, and the resultant danger of a web break, can be reduced. However, in order to provide a simple and dependable method, it is advantageous if the pre-control of at least one of the drives 03, 07, for use in regulating the web tension, is performed, at the latest, with the entry of the start of the new web 01 into the first printing group 14.

In connection with all of the described preferred embodiments, the pre-control, or the taking into consideration of other wrong behavior, detected in the course of production printing, by measurement or by observation, and to be expected, can be performed by the above-described method prior to the appearance of the negative results. These incorrect behaviors can be errors affecting the print quality or the printing process, for example, balance errors, gear-meshing errors, groove beating, folding blade beating, interference by the skip slitter, in the course of transverse perforation, natural vibrations, or other error sources. All of these error sources can be measured or can be observed in the front area, can be evaluated, and can be "imprinted" as a correction value "k" on the regulating device 21, or on the drive units 26, 27, 28, 29, 31, 34, 36 37 38, 39 ahead of the negative effects arising from these various error sources.

The regulation of the registers and/or indexing devices, in accordance with the present invention, is performed in the following manner:

During production operations, for example, monitoring and regulation of the registers and indexing devices takes place continuously by use of the sensor or sensors 19, the regulating device 21 and the actuating drive units 26, 27, 28, 29, 31, or by use of the angular position of the drive units 34, 36, 37, 38, 39, 39. If a roll change is impending, the measured values "m", and finally the correction values k for the impending correction to be expected, are formed by operation of the measuring system 32.

It is now possible to pre-regulate or to pre-control the registers or the indexing devices in expectation of a defined, anticipated change. The correction values "k" are supplied either immediately prior to gluing, or during the entry of the gluing point into the draw-in device. At the latest, these correction values "k" are supplied immediately prior to the exit of the gluing point out of the draw-in device 03 and are supplied to the actuating drive units 26, 27, 28, 29, 31, or to the drive units 34, 36, 37, 38, 39, and possibly 39, or are supplied successively, along with the progress of the gluing point through the printing press, to the actuating drive units 26, 27, 28, 29, 31, or to the drive units 34, 36, 37, 38, and possibly 39, and the correction is thus performed.

If directly following the pre-regulation or pre-control, regulations in one or the other direction are performed by the regulating device 21 for the "normal" register regulation, these values can be read back into the evaluation unit 33, for example, and can be used for forming a correction in the future with comparably measured values "m".

The regulation of the web tension takes place in the same or in a similar way. In web tension regulation, the correction values "k" are supplied to the units affecting the web tension, such as the traction rollers and/or the compensation rollers.

While methods and devices for controlling the drive units in a printing machine, in accordance with the present invention, have been set forth fully and completely hereinabove, it will be apparent to one of skill in the art that various changes in, for example, the specific nature of the web being printed, the construction of the printing units, the types of drive motors, and the like could be made without departing from the true spirit and scope of the present invention which is accordingly to be limited only by the appended claims.

What is claimed is:

1. A method for controlling drive units of a printing press including:

providing at least first and second printing groups and locating them successively in a web conveying direction;

providing at least one drive unit for each of said at least first and second printing groups;

passing a web through said at least first and second printing groups during a printing process;

sensing a value of said web which affects the printing process;

controlling said drive units in response to said web value;

determining at least said web value of a fresh web to be used in said printing process prior to performing a web change;

using said at least one fresh web value and determining a deviation of said fresh web value affecting said printing process from said web value prior to performing said web change; and controlling at least one of said drive units in response to said deviation of said value affecting said printing process at least coincidentally with the entry of a start of said fresh web into a second one of said at least first and second printing groups.

2. The method of claim 1 further including using said at least one measured value for forming at least one corrective value and controlling at least one of said drive units by using said at least one corrective value.

3. The method of claim 2 further including providing said at least one corrective value directly to said at least one drive unit.

4. The method of claim 2 further including providing a regulating device for controlling said drive units and supplying said at least one corrective value to said regulating device.

5. The method of claim 2 further including providing said drive units as actuating drive units and controlling said actuating drive units by said at least one corrective value.

6. The method of claim 2 further including changing a relative angular position of individual ones of said drive units with respect to each other by using said at least one corrective value.

7. The method of claim 6 further including changing said relative angular positions of said drive units with respect to each other.

8. The method of claim 6 further including changing said relative angular drive positions of drive units of one of individually driven printing groups and printing group cylinders in respect to each other.

9. The method of claim 1 further including controlling said at least one of said drive units for regulating at least one of register and indexing devices of said printing press.

10. The method of claim 9 further including removing an automatic register regulation from service during said pre-control process.

11. The method of claim 1 further including controlling said at least one of said drive units for web tension regulation.

12. The method of claim 11 further including providing an automatic web tension regulation device and removing said automatic web tension regulation device from operation at least during said pre-control.

13. The method of claim 1 further including:

providing at least one of register and indexing device of each one of said drive units;

determining said deviation in said at least one of said register and indexing device in response to said web passing through said at least first and second printing groups;

providing a roll stand for webs to be supplied to said printing press;

determining a time of a roll change;

determining an application time for controlling said to at least one of said drive units in accordance with said time of a roll change, and in accordance with a web speed and a web path from said roll changer to said at least one of said drive units; and controlling said at least one of said drive units in accordance with said deviation in said at least one of said register and indexing device at said application time.

14. The method of claim 13 further including providing web quality information and using said web quality information for determining said deviation to be expected in said at least one of said register and indexing devices.

15. The method of claim 14 further including determining a quality value of said web for characterizing a quality of a web to be exchanged.

* * * * *